US005487678A

United States Patent [19]

Tsuji et al.

[11] Patent Number: 5,487,678

[45] Date of Patent: Jan. 30, 1996

[54] CONNECTOR HOUSING HAVING A LOCK MECHANISM

[75] Inventors: Masanori Tsuji; Motohisa Kashiyama; Takuya Kitamura, all of Shizuoka, Japan

[73] Assignee: Yazaki Corporation, Japan

[21] Appl. No.: 335,976

[22] Filed: Nov. 4, 1994

[30] Foreign Application Priority Data

Nov. 8, 1993 [JP] Japan ..... 5-059839 U

[51] Int. Cl.[6] ..... H01R 13/627

[52] U.S. Cl. ..... 439/352; 439/353; 439/358

[58] Field of Search ..... 439/345, 350, 439/352, 353, 354, 357, 358

[56] References Cited

U.S. PATENT DOCUMENTS

| | | | |
|---|---|---|---|
| 4,955,816 | 9/1990 | Roberts et al. | 439/358 X |
| 4,969,838 | 11/1990 | Himes, Jr. et al. | 439/484 X |
| 5,011,425 | 4/1991 | Van Zanten et al. | 439/353 |
| 5,104,253 | 4/1992 | Zielinski et al. | 439/354 X |
| 5,277,627 | 1/1994 | Matsuzaki | 439/353 X |

FOREIGN PATENT DOCUMENTS 61-138174 8/1986 Japan .

62-25479 2/1987 Japan .

*Primary Examiner*—Khiem Nguyen

*Attorney, Agent, or Firm*—Venable, Baetjer, Howard & Civiletti

[57] ABSTRACT

A connector housing assembly used for connection in an electrical wiring and having a pair of connector housings capable of being fitted to each other. A locking arm is provided on one of the pair of connector housings, while a lock hook capable of receiving the locking arm is provided on the other connector housing. The locking arm extends in the direction of fitting of the connector housings and forms a free end portion at its fitting end. The locking arm has an engagement projection and an operating lever extending in the direction opposite to the direction toward the free end. To detach the connector housings from each other, the operating lever is moved upward to be rotated on a fulcrum so as to downwardly move the free end portion of the locking arm, thereby unlocking the locking arm. Thus, a locking arm having an operating lever is provided to form a lock mechanism improved in handling, which enables a pair of connector housings to be easily fitted to or detached from each other.

4 Claims, 4 Drawing Sheets

CONNECTOR HOUSING HAVING A LOCK MECHANISM

BACKGROUND OF THE INVENTION

1. Field of the Invention

The present invention relates to a connector used for connection in an electrical wiring and, more particularly, to a connector housing having a lock mechanism.

2. Description of the Related Art

Connectors having a pair of connector housings and a lock mechanism provided on the connector housings to fix the same on each other have been proposed.

For example, Japanese Utility Model Laid-Open Publication No. 138174/1986 discloses a mechanism having a locking arm provided on one of a pair of connector housings and a lock frame provided on the other connector housing to lock the connector housings in a fitted state. The locking arm has an engagement claw on the fitting side and an unlocking button at its intermediate position.

In this locking mechanism, the locking arm of one connector housing is fitted in the lock frame on the other connector housing when the connector housings are fitted to each other. An engagement claw of the locking arm is thereby brought into engagement with the lock frame, thereby locking the connector housings.

When the connector housings are unlocked to be detached from each other, it is necessary to disengage the engagement claw of the locking arm from the lock frame by applying a force to the connector housings in a direction such that one of the connector housings is moved slightly relative to the other in the direction of insertion while pressing a lock release button and then to move the inserted connector housing apart from the other connector housing.

Under a certain condition of the connector relating to the mounted position, the operation of pressing the lock release button is difficult to perform and the facility with which the connector housings are detached is considerably reduced. Also, the operation of detaching the connector housings has such a directionality that the adaptability of the connector is restricted.

SUMMARY OF THE INVENTION

In view of the above-described problems, an object of the present invention is to provide a connector housing having a lock mechanism improved in handling so that two connector parts can be easily fitted to or detached from each other.

To achieve this object, according to the present invention, there is provided a connector housing assembly comprising a pair of connector housings and a lock mechanism including a flexible locking arm provided on one of the two connector housings and having a free end portion extending in a direction of fitting of the two connector housings, an engagement projection provided in the vicinity of the free end portion, and an operating lever extending in a direction opposite to the direction toward the free end portion, the lock mechanism also including a lock hook provided on the other of the two connector housings and capable of receiving the locking arm. When the connector housings are detached from each other, the operating lever, provided on the locking arm, is operated to unlock the connector housings in such a manner that the operating lever is moved upward by an operator's finger or the like to rotate on a fulcrum to unlock the locking arm, thereby enabling the connector housings to be easily detached from each other. The operation of upwardly moving the operating lever can be performed easily by an operator's finger or the like in a wide-angle operating range, and there is no special operating directionality. Therefore, the detachment operation is easily to perform regardless of the position or place in which the connector is mounted, thus improving the facility with which the connector is used. Also, the adaptability of the connector is improved to widen the use or the field of use of the connector.

These and other objects, features and advantages of the present invention will become apparent from the following detailed description of preferred embodiments of the invention taken in conjunction with the accompanying drawings.

DESCRIPTION OF THE PREFERRED EMBODIMENTS

Figure 1:
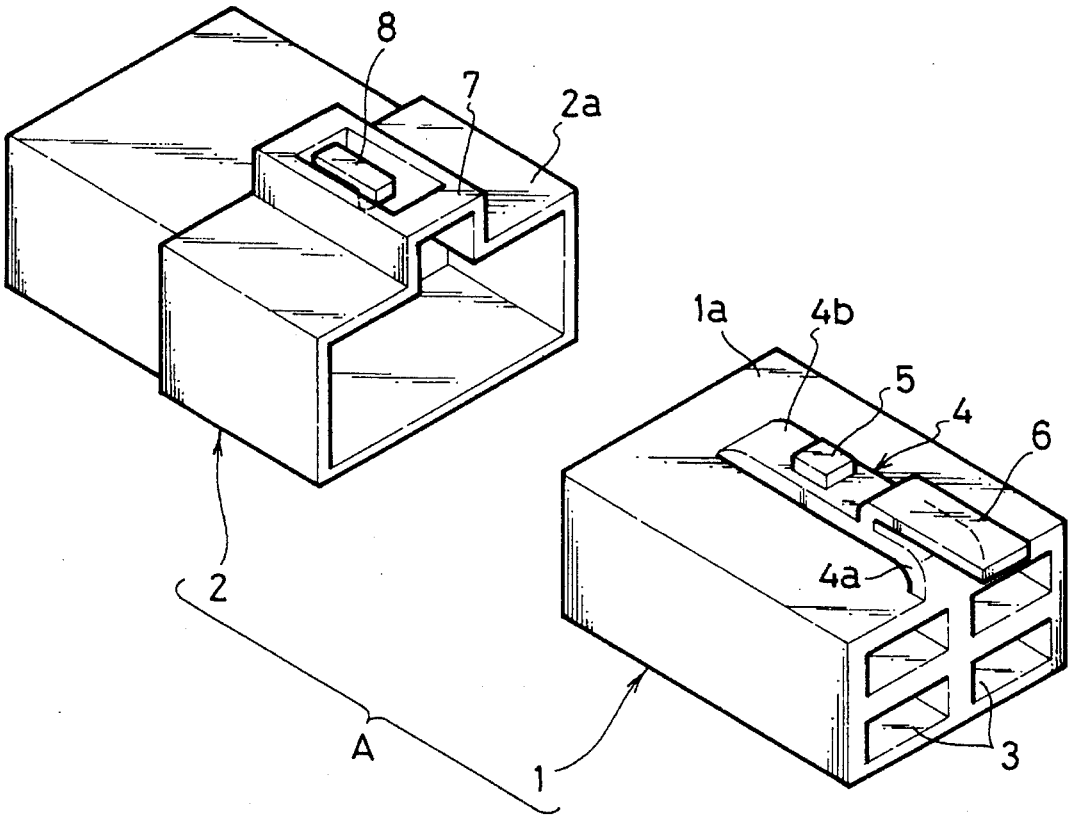
FIG. 1 is a perspective view of a connector housing having a lock mechanism in accordance with a first embodiment of the present invention.

A connector housing A having a lock mechanism in accordance with the first embodiment of the present invention will be described with reference to FIGS. 1 through 3. The connector housing A consists of a pair of housing portions (hereinafter referred to as first and second connector housings) 1 and 2 which form a connector when fitted to each other.

The first connector housing 1 is a male housing having a plurality of internal terminal chambers 3. The first connector housing 1 has an upper wall portion 1*a* and a flexible locking arm 4 provided on the upper portion 1*a*. The locking arm 4 has a support portion 4*a* connected to the upper wall portion 1*a* of the connector housing 1. The locking arm 4 extends from the support portion 4*a* in the direction of fitting into the second connector housing 2 and has a free end portion 4*b* at a fitted end. An engagement projection 5 is provided between the support portion 4*a* and the free end portion 4*b*. An operating lever 6 is provided which extends from a position at the rear of the engagement projection 5 in the direction opposite to the direction of the free end portion 4*b*.

The second connector housing 2 is a female housing formed into a tubular shape such as to accommodate the first connector housing 1. The second connector housing 2 has an upper wall portion 2*a* and a frame portion, i.e., an engagement frame 7, which opens in the direction of fitting to the first connector housing 1. A flexible lock hook 8 is provided at the rear of the engagement frame 7 so as to extend along a fitting axis. The lock hook 8 has an engagement claw 8*a* engageable with the engagement projection 5.

Figure 2:
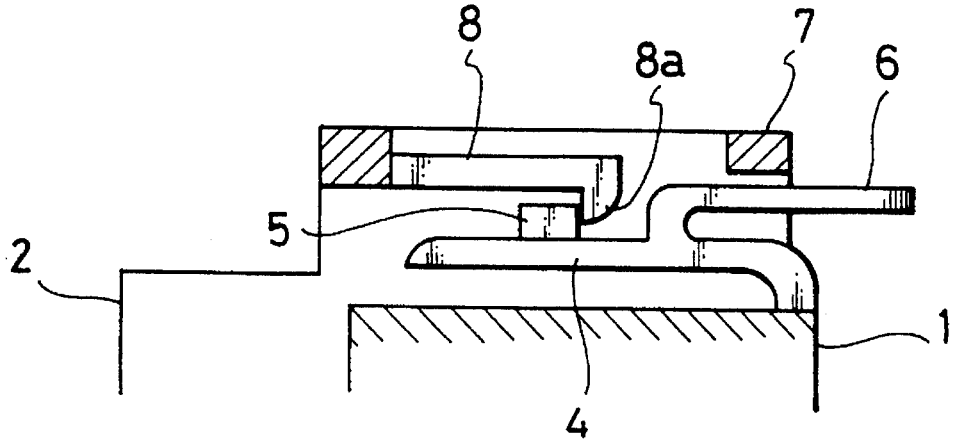
FIG. 2 is a diagram showing a state in which the pair of connector housings shown in FIG. 1 are fitted and locked to each other.

FIG. 2 shows a state of the first and second connector housings 1 and 2 in which the housings 1 and 2 are fitted and locked to each other. The locking arm 4 of the first connector housing 1 is fitted into the engagement frame 7 of the second connector housing 2, and the engagement projection 5 of the locking arm 4 is engaged with the engagement claw 8*a* of the lock hook 8 to prevent the first connector housing 1 from coming off the second connector housing 2.

Figure 3:
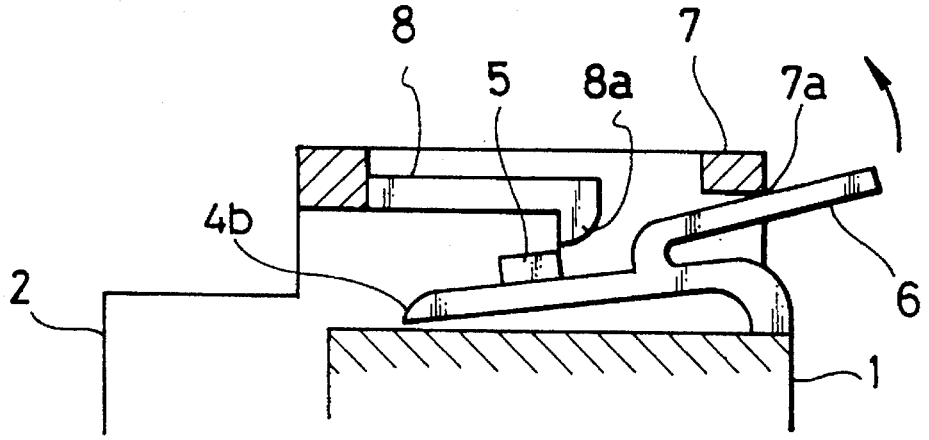
FIG. 3 is a diagram showing an operation of detaching the pair of connector housings shown in FIG. 2 from each other.

FIG. 3 illustrates an operation of detaching the first connector housing 1 from the second connector housing 2. When the operating lever 6 is moved upward by an operator's finger or the like in the direction of the arrow, the operating lever 6 is brought into contact with an inner side 7*a* of a bridge portion which forms a front upper frame portion of the engagement frame 7. The inner side 7*a* serves as a fulcrum. As the operating lever 6 is further moved upward in the direction of the arrow, the free and portion 4*b* of the locking arm 4 is moved downward, thereby disengaging the engagement projection 5 of the locking arm 4 and the engagement claw 8*a* of the lock hook 8. The first and second connector housings 1 and 2 can easily be detached from each other by moving the first connector housing 1 apart from the second connector housing 2 while maintaining the engagement projection 5 in the state of being disengaged from the lock hook 8.

Figure 4:
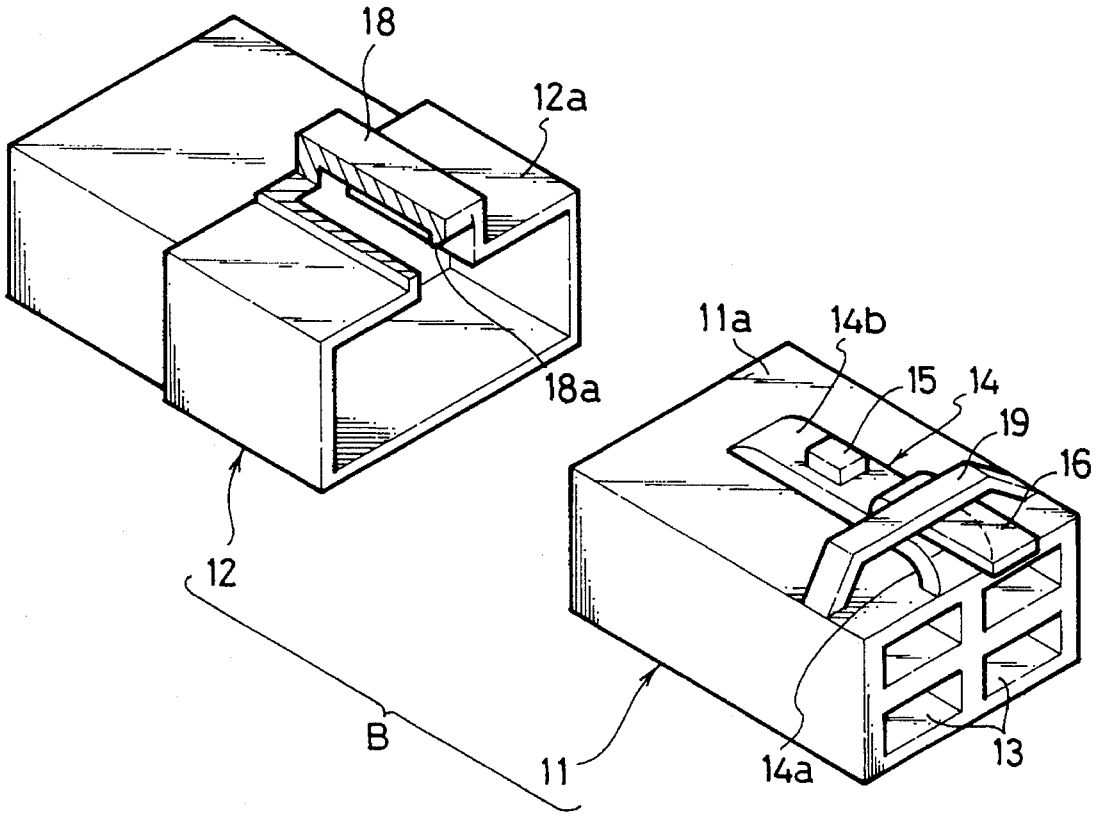
FIG. 4 is a perspective view of a connector housing having a lock mechanism in accordance with a second embodiment of the present invention.

A connector housing B having a lock mechanism in accordance with the second embodiment of the present invention will be described with reference to FIGS. 4 through 6.

The connector housing B consists of first and second connector housings 11 and 12 which form a connector when fitted to each other.

The first connector housing 11 is a male housing having a plurality of internal terminal chambers 13, as in the case of the first embodiment. The first connector housing 11 has an upper wall portion 11*a*, a flexible locking arm 14 provided on the upper wall portion 11*a*, and a support frame 19 for supporting the locking arm 14. The locking arm 14 has a support portion 14*a* connected to the upper wall portion 11*a* of the connector housing 11. The locking arm 14 extends from the support portion 14*a* in the direction of fitting into the second connector housing 12 and has a free end portion 14*b* at a fitted end. An engagement projection 15 is provided between the support portion 14*a* and the free end portion 14*b*. An operating lever 16 is provided which extends from a position at the rear of the engagement projection 15 in the direction opposite to the direction of the free end portion 14*b*. The support frame 19 is formed on the upper wall portion 11*a* of the first connector housing 11 so as to surround the operating lever 16 of the locking arm 14.

The second connector housing 12 is a female housing formed into a tubular shape such as to accommodate the first connector housing 11. The second connector housing 12 has an upper wall portion 12*a* and a lock hook 18 formed on the upper wall portion 12*a* and having an engagement claw 18*a* in the vicinity of a portion fitted to the first connector housing 11.

Figure 5:
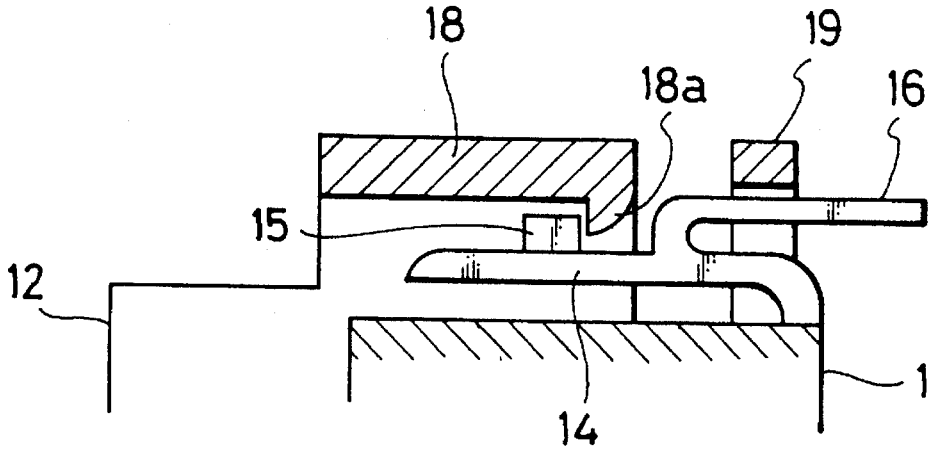
FIG. 5 is a diagram showing a state in which the pair of connector housings shown in FIG. 4 are fitted and locked to each other.

FIG. 5 shows a state of the first and second connector housings 11 and 12 in which the housings 11 and 12 are fitted and locked to each other. The engagement projection 15 of the locking arm 14 is engaged with the engagement claw 18*a* of the lock hook 18 to prevent the first connector housing 11 from coming off the second connector housing 12.

Figure 6:
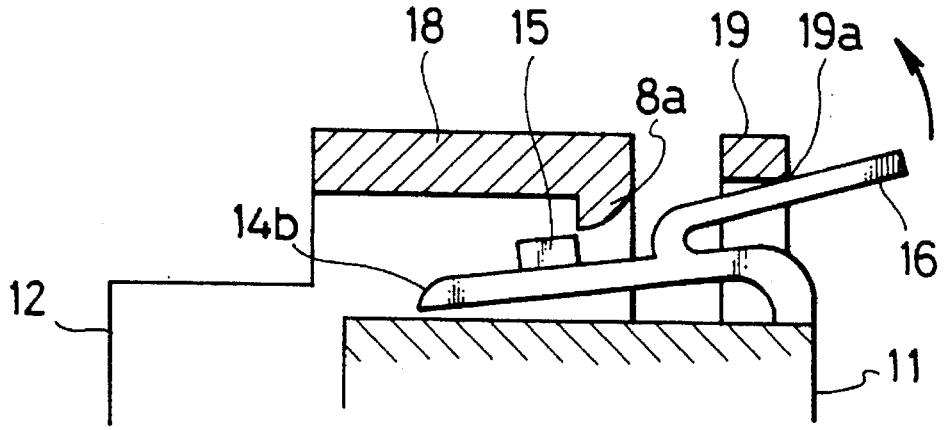
FIG. 6 is a diagram showing an operation of detaching the pair of connector housings shown in FIG. 5 from each other.

FIG. 6 illustrates an operation of detaching the first connector housing 11 from the second connector housing 12. When the operating lever 16 is moved upward by an operator's finger or the like as in the direction of the arrow, the operating lever 6 is brought into contact with an inner side 19*a* of a bridge portion which forms a front upper frame portion of the support frame 19. The inner side 19*a* serves as a fulcrum. As the operating lever 16 is further moved upward in the direction of the arrow, the free end portion 14*b* of the locking arm 14 is moved downward, thereby disengaging the engagement projection 15 of the locking arm 14 and the engagement claw 18*a* of the lock hook 18. The first and second connector housings 11 and 12 can be easily detached from each other by moving the first connector housing 11 apart from the second connector housing 12 while maintaining the engagement projection 15 in the state of being disengaged from the lock hook 18.

What is claimed is:

1. A connector housing comprising:

a first connector housing and a second connector housing capable of being fitted to each other;

a lock mechanism for fixing said first and second connector housings in a fitted state, said lock mechanism including a locking arm provided on said first connector housing and having a free end portion extending in a direction of fitting of said first and second connector housings and an engagement member, said lock mechanism also including a lock member capable of receiving and engaging with said locking arm;

disengagement means for disengaging said lock mechanism, said disengagement means including an operating lever extending from said locking arm in a direction opposite to the direction toward the free end portion of said locking arm, said operating lever being capable of moving outward and generally perpendicularly to the direction of fitting of said first and second connector housings to cause a swinging motion of said locking arm such that said locking arm and said lock member are disengaged from each other; and a frame member in which said locking arm can be inserted, said frame member is provided on said second connector housing, and said frame member contacts said locking arm at its inner end during the outward motion of said operating lever to form a fulcrum of the swinging motion of said locking arm.

2. A connector housing according to claim 1, wherein said lock member provided on the second connector housing is positioned at the rear of said frame member and includes a lock hook having a claw engageable with the engagement member of said locking arm.

3. A connector housing comprising:

a first connector housing and a second connector housing capable of being fitted to each other;

a lock mechanism for fixing said first and second connector housings in a fitted state, said lock mechanism including a locking arm provided on said first connector housing and having a free end portion extending in a direction of fitting of said first and second connector housings and an engagement member, said lock mechanism also including a lock member capable of receiving and engaging with said locking arm;

disengagement means for disengaging said lock mechanism, said disengagement means including an operating lever extending from said locking arm in a direction opposite to the direction toward the free end portion of said locking arm, said operating lever being capable of moving outward and generally perpendicularly to the direction of fitting of said first and second connector housings to cause a swinging motion of said locking arm such that said locking arm and said lock member are disengaged from each other; and a support frame, said support frame is provided on said first connector housing so as to surround and support said locking arm, and said support frame contacts said locking arm at its inner end during the outward motion of said operating lever to form a fulcrum of the swinging motion of said locking

4. A connector housing according to claim 3, wherein said lock member provided on the second connector housing includes a lock hook having a claw engageable with the engagement member of said locking arm.

* * * * *